US008567105B1

(12) United States Patent
Bobro

(10) Patent No.: US 8,567,105 B1
(45) Date of Patent: Oct. 29, 2013

(54) WEAPONS INTERFACE MOUNTING DEVICE

(76) Inventor: Andrew Bobro, Santa Barbara, CA (US)

( * ) Notice: Subject to any disclaimer, the term of this patent is extended or adjusted under 35 U.S.C. 154(b) by 0 days.

(21) Appl. No.: 12/607,996

(22) Filed: Oct. 29, 2009

Related U.S. Application Data

(60) Provisional application No. 61/111,285, filed on Nov. 4, 2008.

(51) Int. Cl.
*F41C 27/00* (2006.01)

(52) U.S. Cl.
USPC ..... 42/90; 42/127; 42/148

(58) Field of Classification Search
USPC ..... 42/124–127, 148, 90, 111, 146
See application file for complete search history.

(56) References Cited

U.S. PATENT DOCUMENTS

| | | | | |
|---|---|---|---|---|
| 3,324,558 | A * | 6/1967 | Hart | 42/127 |
| 5,155,915 | A * | 10/1992 | Repa | 42/127 |
| 5,276,988 | A * | 1/1994 | Swan | 42/127 |
| 5,680,725 | A * | 10/1997 | Bell | 42/127 |
| 6,442,883 | B1 * | 9/2002 | Waterman et al. | 42/124 |
| 6,637,144 | B2 * | 10/2003 | Nelson et al. | 42/120 |
| 6,773,172 | B1 * | 8/2004 | Johnson et al. | 248/187.1 |
| 6,874,269 | B2 * | 4/2005 | Chen et al. | 42/85 |
| 6,922,934 | B1 * | 8/2005 | Huan | 42/127 |
| 6,931,778 | B1 * | 8/2005 | Nelson et al. | 42/120 |
| 7,077,582 | B2 * | 7/2006 | Johnson | 396/428 |
| 7,107,716 | B1 * | 9/2006 | Liao | 42/108 |
| 7,260,912 | B2 * | 8/2007 | Liu | 42/127 |
| 7,272,904 | B2 * | 9/2007 | Larue | 42/127 |
| 7,370,449 | B1 * | 5/2008 | Beckmann | 42/90 |
| 7,493,721 | B2 * | 2/2009 | Swan | 42/125 |
| 7,562,485 | B2 * | 7/2009 | Newhall et al. | 42/127 |
| 7,614,175 | B2 * | 11/2009 | Davis et al. | 42/127 |
| 7,685,759 | B2 * | 3/2010 | Teetzel | 42/127 |
| 7,739,824 | B1 * | 6/2010 | Swan | 42/124 |
| 7,757,422 | B1 * | 7/2010 | Swan | 42/96 |
| 7,757,423 | B1 * | 7/2010 | Swan | 42/127 |
| 7,802,395 | B1 * | 9/2010 | Swan | 42/127 |
| 7,823,316 | B2 * | 11/2010 | Storch et al. | 42/90 |
| 7,886,476 | B1 * | 2/2011 | Swan | 42/127 |
| 7,905,045 | B1 * | 3/2011 | Swan | 42/127 |
| 7,908,782 | B1 * | 3/2011 | LaRue | 42/128 |
| 2002/0162267 | A1 * | 11/2002 | Nelson et al. | 42/120 |
| 2006/0117636 | A1 * | 6/2006 | Newhall et al. | 42/124 |
| 2006/0123686 | A1 * | 6/2006 | Larue | 42/127 |
| 2006/0207156 | A1 * | 9/2006 | Larue | 42/127 |
| 2008/0092421 | A1 * | 4/2008 | Beckmann | 42/90 |
| 2008/0168696 | A1 * | 7/2008 | Orne et al. | 42/90 |
| 2008/0178511 | A1 * | 7/2008 | Storch et al. | 42/90 |
| 2008/0216380 | A1 * | 9/2008 | Teetzel | 42/127 |
| 2009/0038201 | A1 * | 2/2009 | Cheng et al. | 42/127 |
| 2010/0107467 | A1 * | 5/2010 | Samson et al. | 42/127 |
| 2010/0122485 | A1 * | 5/2010 | Kincel | 42/146 |

* cited by examiner

*Primary Examiner* — Jonathan C Weber
(74) *Attorney, Agent, or Firm* — J. E. McTaggart

(57) ABSTRACT

The weapon interface mounting device is designed to permit a secure interface between a Mil-Std 1913 or similar rail and a compatible component such as an optical device, bipod, or light source. It can be easily installed, requires no adjustment by the user, and will mate securely to rails that are out of specification or poorly manufactured. The weapon interface mounting device utilizes a constant force system that applies adequate pressure to positively secure any accessory or device despite being subject to rough treatment such as recoil shock from a host weapon. Unlike prior art devices, the weapon interface mounting device insures repeatability by utilizing a mechanical index system.

18 Claims, 12 Drawing Sheets

SECTION A-A

Mil-Std 1913 Rail
(Prior Art)
30
31
33
X
Z 31
33
X
Y 34
32
34
Y
Z

WEAPONS INTERFACE MOUNTING DEVICE

CROSS REFERENCE TO RELATED APPLICATIONS

This application is related to and claims priority from earlier filed U.S. Provisional Patent Application No. 61/111,285, filed Nov. 4, 2008.

FIELD OF THE INVENTION

The present invention relates generally to accessory mounting assemblies for combat weapons.

BACKGROUND OF THE INVENTION

As the field of combat and commercial weaponry expands, numerous add-on enhancements have become available for attachment to standard firearms. For example, the well-known M16 weapon system, includes a mil-std 1913 dovetail rail extending along the top of the upper receiver. This rail provides a convenient mounting point for many types of accessories such as tactical lights, night vision devices, laser sighting modules, reflex sights, fore grips, and bipods.

Field modification of weapons is critical in combat situations. As such, standardized attachment assemblies have been developed to allow quick and easy removal and mounting of accessory devices relative to the dovetail rails. Examples of such attachment assemblies are disclosed in U.S. Pat. Nos. 5,276,988 and 7,493,721.

Although some needs have been met with such prior art devices, significant performance issues remain. In particular, manufactured rails having even slight imperfections are not well accommodated by the prior art. They are not well secured and repeated shock due to firing can lead to degradation and eventual failure of the rail/interface system. Accordingly, a need exists for a weapon interface mounting device that performs well regardless of the quality of the rail with which it interfaces.

Although prior art devices posses an indexing system, accessories mounted using such devices nevertheless require adjustment due to residual slack between the rail and the indexing geometry. Clearly, a need also exists for a weapon interface mounting device that is capable of automatic indexing with 100% repeatability that requires no active adjustment by the user.

Prior art devices do not attempt to constrain the rail in all three orthogonal dimensions. This, together with the inherent imperfect manufacturing of such rails, are also responsible for amplification of residual slack that occurs during the firing process, thereby leading to inevitable mechanical failure. A need exists for a weapon interface mounting device that constrains the rail in all three orthogonal dimensions as well as having the capability to fully compensate for residual slack in all dimensions.

OBJECTS OF THE INVENTION

It is an objective of the present invention to provide a lever-deployed clamp-driver system for incorporation into a weapon interface mounting device that is enabled by the driver system to provide extremely rapid removable mounting of a weapon accessory onto a weapon-mounted interface rail in a manner that constrains the rail in all three orthogonal dimensions as well as having the ability to compensate for residual slack in all dimensions.

It is a further objective of the present invention that the lever of the driver system be made and arranged to be readily and rapidly manipulated by a user to rotationally select between (1) an open orientation enabling a disengaged mode for rapid and convenient accessory removal and replacement and (2) a closed orientation enabling an automatically locked in an engaged operational mode wherein the accessory is held, clamped solidly in place on the rail.

It is a further objective of the present invention to provide a weapon interface mounting device that incorporates the modular lever-activated mechanism for extremely rapid deployment and removal of accessories, that provides automatic compensation for dimensional variations and that requires no threaded adjustment manipulation and yet performs well regardless of out-of-specification deviations in the quality of the rail with which it interfaces.

It is an objective of the present invention to provide a weapon interface mounting device that is capable of automatic indexing with 100% repeatability.

SUMMARY OF THE INVENTION

The above objectives are met by a first main embodiment, i.e. a lever-activated clamp-driver system intended as a marketable product for attachment to and incorporation with complementary components that can be readily incorporated into clamping-type mounting systems and devices, and by a second main embodiment, i.e. a clamping-type mounting device operable for serving as an interface between a rail mounted to a weapons platform and an accessory.

Functionally, a mounting device in the field of the present invention can be regarded as essentially a basic C-clamp forceably engaging a workpiece, in this case the rail, between a fixed clamp jaw and a movable clamp jaw that can manipulated by the user to apply/release the clamping force.

The clamping driver system embodiment enables a mounting device to provide mateable engagement clamped onto the rail at a desired location along the firing axis, the direction of the path taken by a bullet. The mounting device may also be made in a version that is operable for providing repeatable indexing capability between the weapons platform and the accessory As a major point of the invention, the clamping driver system includes a compressible drive component having a lever-driven side that receives compressive clamping force from a cam configured on the lever arm, pivoting about a common pivot pin within a range approximating 90 degrees, and a movable clamp jaw configured at the second and opposite driving side of the compressible drive component, made and arranged to transmit clamping force from the cam onto the proximal side edge of the rail.

The cam-originated displacement transmitted via the compressible drive component is designed to have sufficient stroke-length that moving the lever to initiate the disengaged mode facilitates initial attachment of a mounting device onto the rail and, when mounted with the lever locked in the engaged mode, to generate sufficient compressive clamping force with further capability to automatically compensate and take up the slack for dimensional variations in rail width, even with a rail that is poorly manufactured, e.g. with dimensions falling substantially outside specified tolerances.

The accessory-to-weapon clamping device embodiment of the invention can be regarded functionally and structurally as a C-clamp having two major portions: (1) a first portion constituting essentially the clamping driver system embodiment, with the movable clamp-jaw engaging the proximal side edge of the rail, and (2) a second portion having a first end operationally combined with the first portion, a mid-region serving as main clamp body providing an accessory-mounting platform and extending across above the rail to a fixed clamp-jaw portion that engages the rail.

In basic form, the mounting device of the second embodiment provides the capability for a lever activated continuous positional adjustment and clamped setting anywhere along the rail.

To the extent that this clamping capability maintains positive interlock integrity for at least two out of three possible orthogonal dimensions along with substantial interlock integrity for the third dimension, the lever activated automatically-compensated clamping capability of the basic mounting device acts to take up the slack for a poorly manufactured rail and provides support in maintaining positional integrity and helps the indexing process in absorbing the recoil shock during firing.

In an optional variation of the second embodiment of the invention, the mounting device may be made to include enhanced capability of indexing by the further incorporation of an articulate finger that engages adjacent crosswise indexing slots of the MIL-STD-1913 or similar rail. An expansion feature of the articulate finger takes up slack to compensate for dimensional variations including tolerances in the indexing slots of the manufactured rail, facilitating the indexing process and ensuring positional integrity in accommodating recoil during firing.

DESCRIPTION

The term "firing axis", as used herein, is used to define the longitudinal axis of a firearm as shown in FIG. 1. Its positive direction is collinear with that taken by a bullet as shown in the figure. It is denoted the "x axis" in FIGS. 4-9.

The term "orthogonal to the firing axis", as used herein, is used to define the plane orthogonal to the firing axis as defined by a right-handed coordinate system. It is the "yz" plane as denoted in FIGS. 4-9.

BRIEF DESCRIPTION OF THE ITEMS SHOWN IN THE FIGURES

1—firearm
2—accessory
9—auxiliary indexing component
10—weapon interface mounting device a.k.a. clamp embodiment
11—clamp body, forming channel
12 accessory-mounting surface
13—primary indexing component
14—compressible edge configuration of 13 a.k.a. articulated finger
15—compressible drive subassembly
16—driver system a.k.a. driver embodiment
17—shaped surface of fixed clamp jaw
18—shaped surface of movable clamp-jaw 71
19—lever
19A—pivot point of lever
19B—cam portion of lever
20—safety a.k.a bar, lock, latch
30—rail such as the MIL STD-1913
31—ridges on rail for indexing
32—rail cross-section
33—slots on rail for indexing
34—beveled edges a.k.a. angled rail-edge facet
60—driver housing
71—movable clamp-jaw driven from compressible drive component 73 a.k.a. driver component proximate rail side a.k.a. second spring-end retainer
71A—offset extension portion of 71
72—rail-mating angled facet surface on 71A
73—compressible drive component variable resistance member
74—lever-driven component driving compressible drive component 73 a.k.a. driver component proximate lever side .a.k.a. first spring-end retainer part

DETAILED DESCRIPTION OF THE PREFERRED EMBODIMENT

Figure 1:
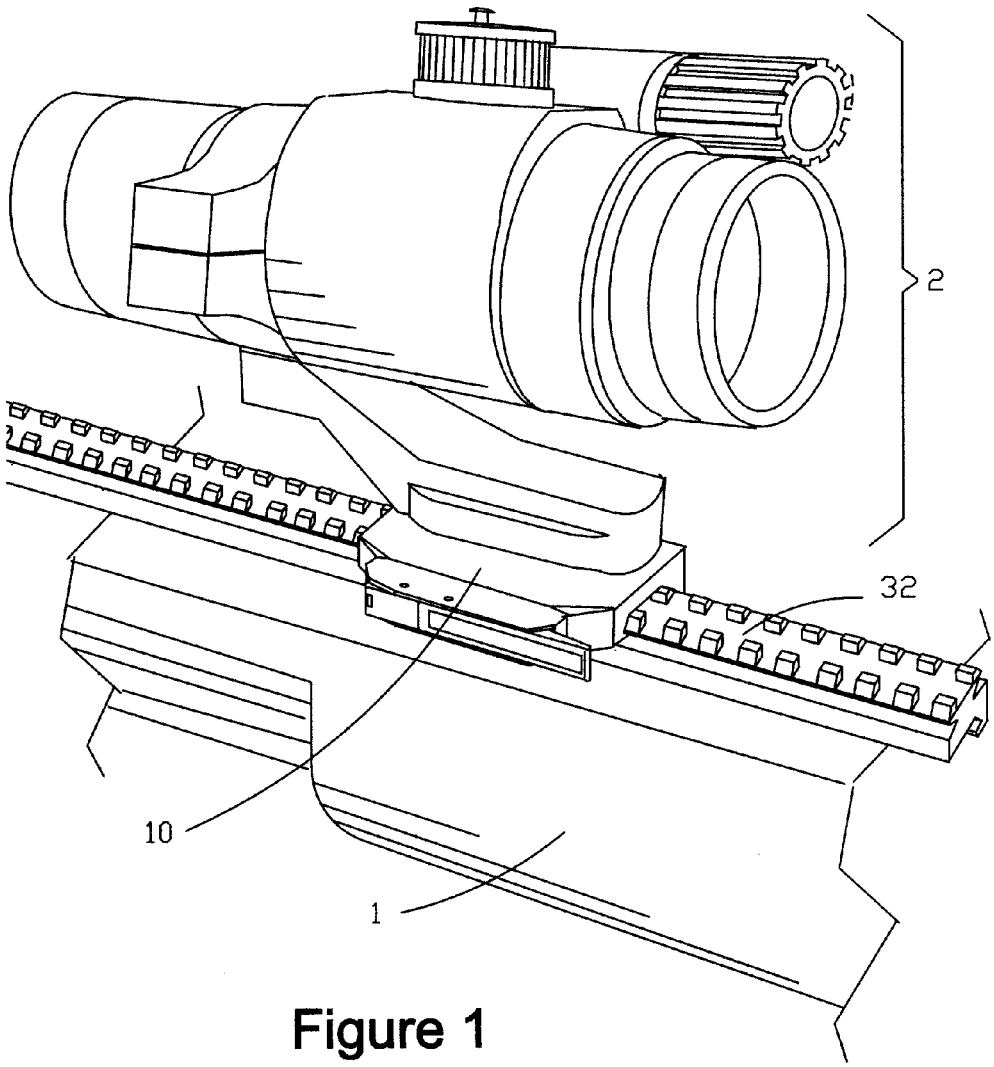
FIG. 1—weapon interface mounting device functioning as an interface between a firearm and mounted accessory.
Figure 1C:
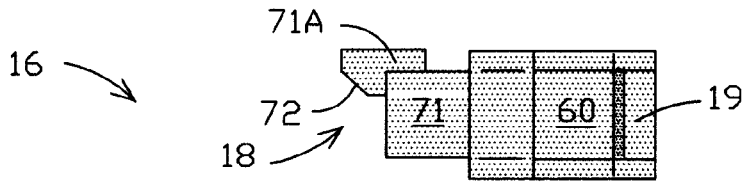
FIGS. 1A-1E—Five views of the claimed clamping driver system.embodiment.
Figures 1A, 1B, 1D:
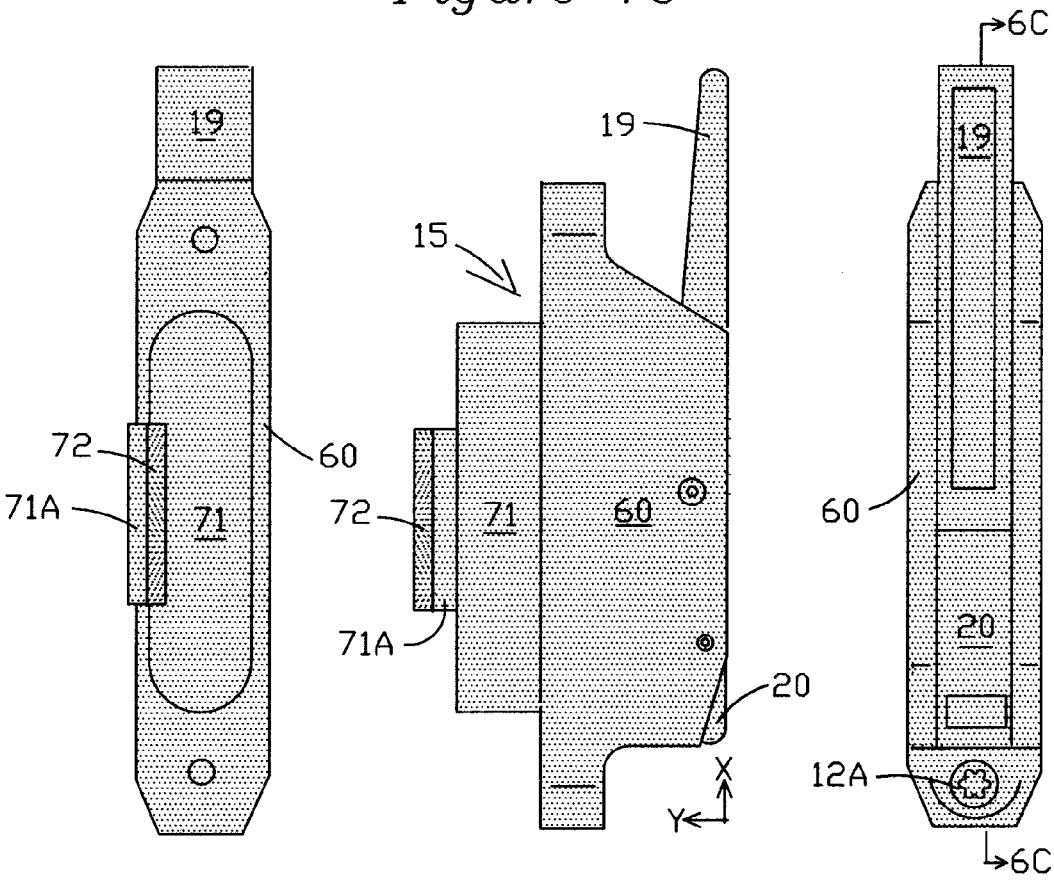
Figure 1E:
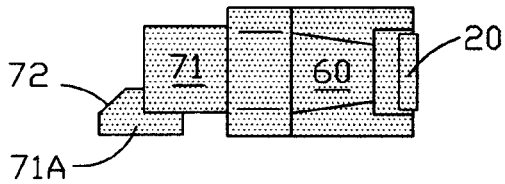

FIG. 1 shows a firearm (1) with an accessory (2) mounted thereto. The mounting apparatus consists of a MIL-STD 1913 rail (30) and the weapon interface mounting device (10) of the present invention. As shown in FIG. 8, the MIL-STD-1913 rail (30) comprises a series of ridges (31) interspersed with flat slots (33). Accessories are mounted by means of a "rail-grabber" which is clamped to the slots (33) or onto the rail (30) itself.

Driver system 16, shown in five orthogonal views in FIGS. 1A-E, constitutes, in a basic form of the invention, a first of two main embodiments. Driver system 16 enables user-manipulation of lever 19 to deploy an automatically-locked operational mode wherein a cam portion 19B of lever 19 transmits compressive clamping force onto a special compressible drive subassembly 15, partially enclosed in driver housing 60 and including a movable clamp-jaw 71, configured with a shaped surface 18 (FIG. 1C) for engaging and clamping a workpiece in co-operation with an external fixed clamp-jaw that is not included in this first main embodiment.

Driver system 16 is configured with a pair of mounting flanges including two holes 12A for bolted attachment to some form of host complementary clamping structure that includes a fixed clamp jaw, thus enabling the creation of clamping devices that can be adapted and directed to various clamping requirements including particularly but not limited to a weapon interface mounting device Optionally, in a particular version of driver system 16 that is specifically intended for incorporation into a weapon interface mounting device utilizing a MIL STD-1913 rail 30 or equivalent, the shaped surface 18 (FIG. 1C) is specially configured as shown also in FIGS. 1A, 1D, 1E, 1F, 5A and 9B, so as to interface and clamp rail 30 as the workpiece at a single angled facet rail-mating surface 72 of the offset extension portion 71A of clamp-jaw 71.

Lever 19 becomes automatically safety-locked in the operational mode shown when manipulated by a user to the orientation shown, releasable only by depressing safety-lock-bar 20.

Figure 1F:
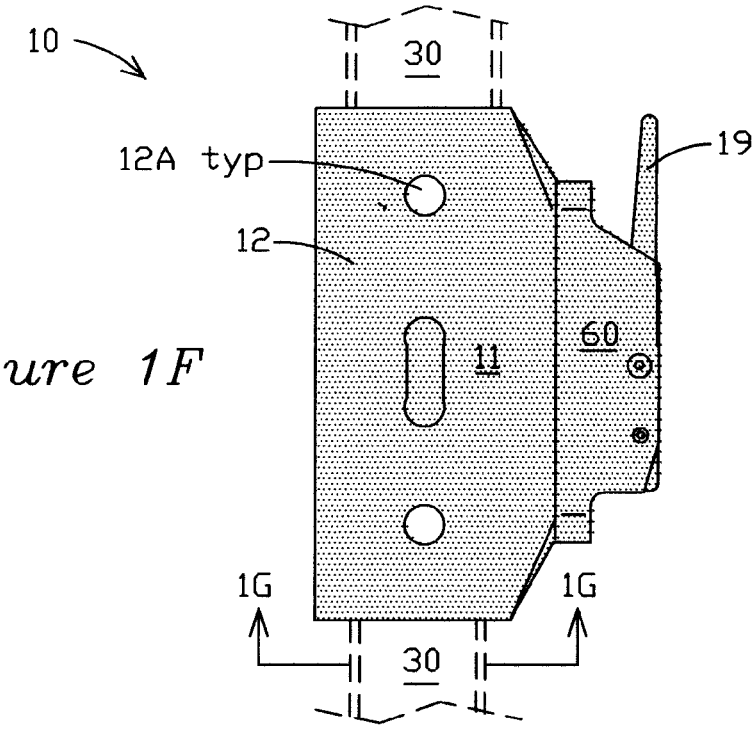
FIGS. 1F-1H—Three views of the claimed weapon interface mounting device embodiment, shown clamped onto a weapon-mounted rail.
Figure 1G:
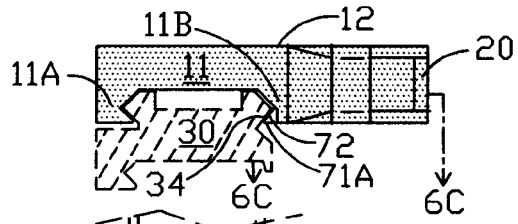
Figure 1H:
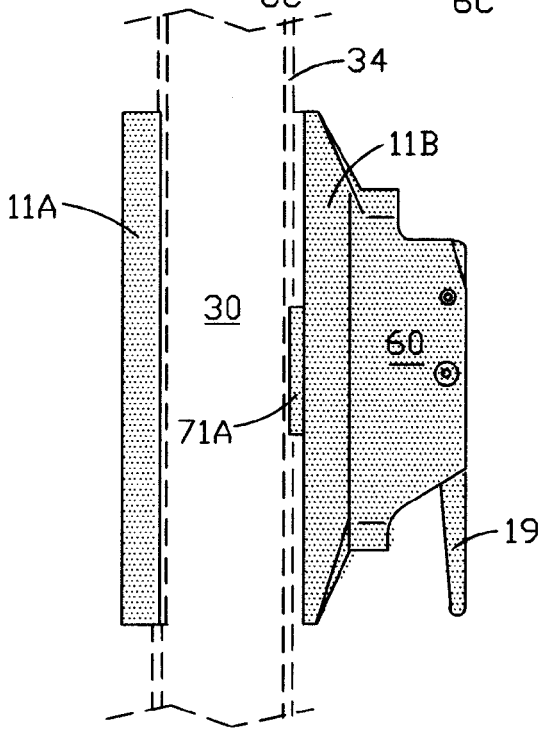

FIGS. 1F-1H show three orthogonal views of a weapon interface mounting device 10, which incorporates the above-described particular version of driver system 16 and constitutes the second of two main embodiments of the invention.

FIG. 1F is a top/plan view of the weapon interface mounting device 10, showing the general appearance as viewed by a user facing the firing direction and looking down onto the weapon.

The main clamp body 11 shown is a version with an alternative shape in place of the generally-orthogonal plan shape shown in FIGS. 1 and 2-6. This alternative shape acts to increase the working area of the accessory-mounting surface 12 (FIGS. 1F and 5A) and the working area of interface interaction with rail 30, otherwise the two shapes are generally equivalent.

Figure 2:
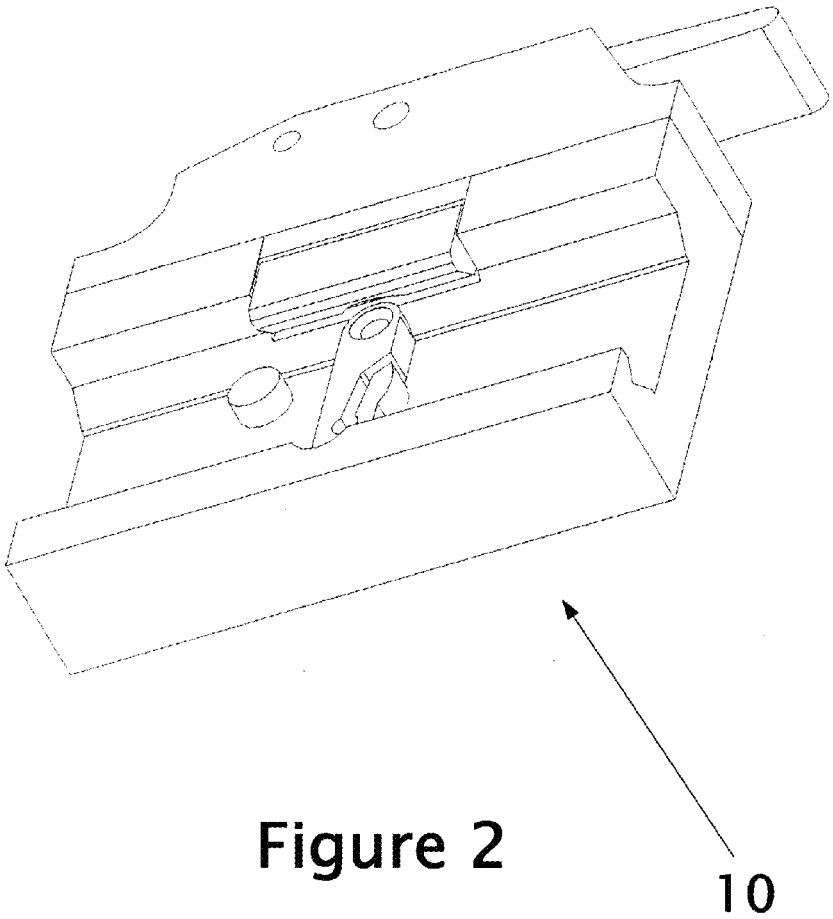
FIG. 2—First perspective view of the weapon interface mounting device.
Figure 3:
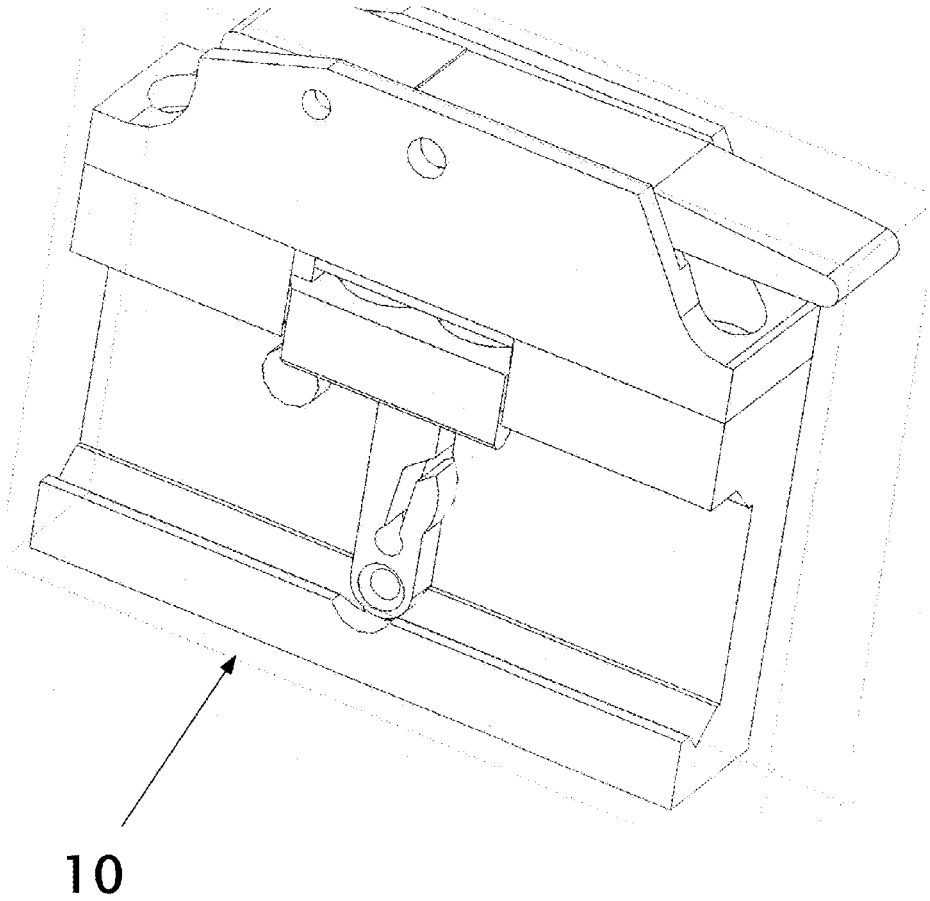
FIG. 3—Alternate perspective view of the weapon interface mounting device.

A driver system 16 is attached to the main clamp body 11 as shown in the optional usual right-handed orientation, i.e. with lever 19 oriented in the firing direction as shown in FIGS. 1, 2 and 3. For left-handed orientation, since the driving housing 60 is configured with a pair of holes 12A for symmetric bolted attachment to clamp body 11, the driver system 16 can be readily mounted to the main clamp body 11 with the direction of lever 19 reversed 180 degrees. Similarly, for left-handed orientation in a system that utilizes primary indexing bar 13, it is designed for convenient mounting reversal to retain recoil impact properties.

FIG. 1G shows a cross-section, taken at 1G-1G of FIG. 1F, showing a main portion of rail 30, traversed overhead by the main clamp body 11 so as to form a channel within which the rail 30 is clamped at its two opposite edges between a fixed jaw 11A configured in main clamp body 11 and movable clamp jaw 71 having a shaped surface 18 including an offset extension portion 71A configured with a single-facet rail-mating angled facet 72.

FIG. 1H depicts a bottom view of rail 30 clamped in place in between channel walls 11A and 11B of main clamp body 11, with the components of the driver system 16 extending through the d river housing 60 and a portion of clamp body 11 such that offset drive extension 72 extends into the channel region as shown to engage the right hand edge 18 of rail 30 as in FIG. 1G . . . .

An optional variation of the weapon interface mounting device 10 further includes an indexing feature shown in and described in connection with FIGS. 2-5.

The second main embodiment of this invention, the weapon interface mounting device (10), is shown in alternate perspective views in FIGS. 2-3. Designed to enable a secure interface between a weapon system and accessory component, it can be modular or custom designed for a particular device. Overall details of the device are shown in FIGS. 4-7. Details of the geometry involved in the interfacing between the device and the rail (30) are indicated in FIG. 9.

The weapon interface mounting device (10) of the present invention accomplishes the following:

1. constrains the rail in all three orthogonal dimensions,
2. compensates for residual slack in each respective dimension, thereby enabling it to:
   perform well regardless of the quality of the rail with which it interfaces,
   act as a "shock absorber" against the recoil of firing, and
3. provides automatic indexing with 100% repeatability.

It accomplishes the above goals by utilizing the following design principles:

a. employing geometrical features mateable to the external dimensions of a Mil-Std 1913 or similar rail (30),
b. exploiting the compliant properties of spring material in the compressible drive component 73, and in the compressible edge 14 of optional primary indexing component 13, to automatically compensate for any residual space between the mating surfaces (9, 13, 14, 31, and 15, 17, 18, 34) of the weapon interface mounting device (10) and the rail (30) as well as providing shock absorbance against the recoil of firing, and
c. providing simple geometry (9, 13) operable for securing both sides of a rail ridge (31).

Figure 4A:
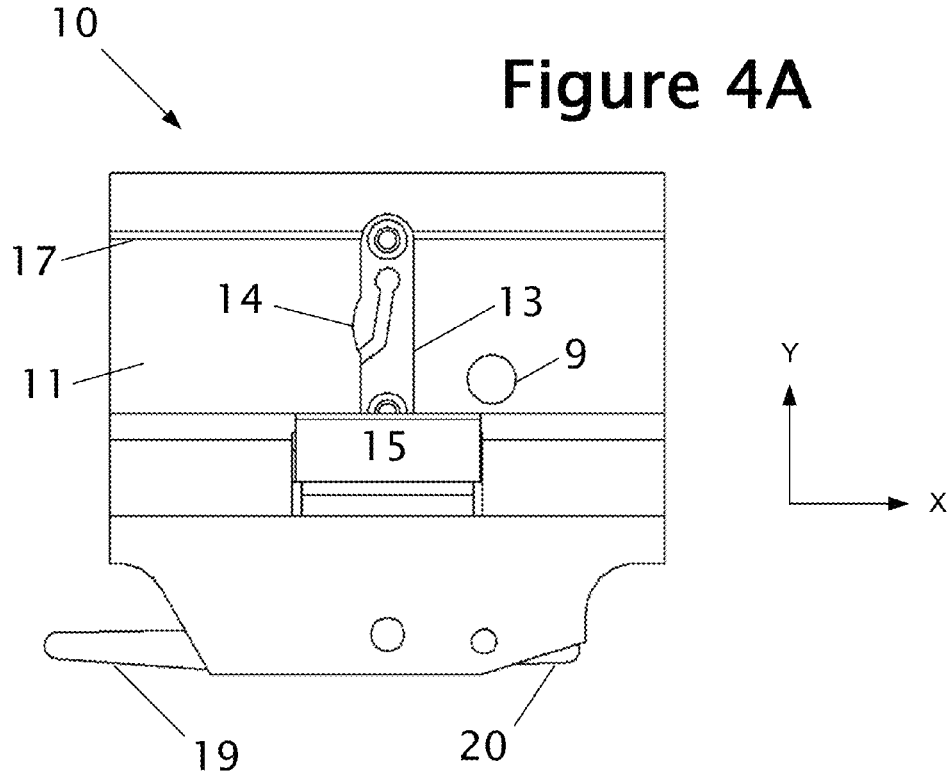
FIG. 4—Top (4A) and end-on (4B) views of the weapon interface mounting device.
Figure 4B:
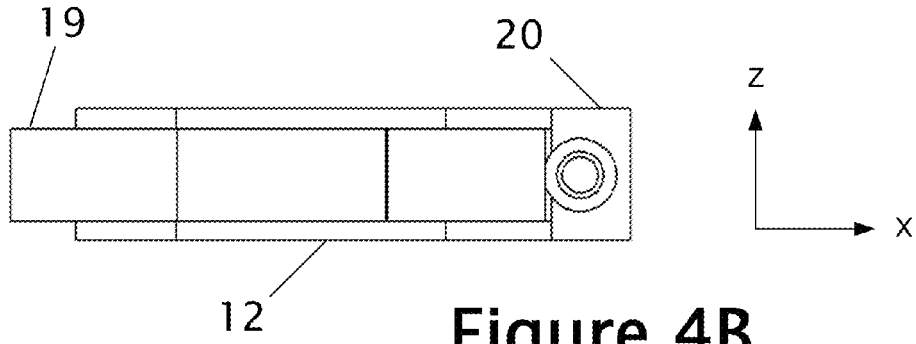
Figure 5A:
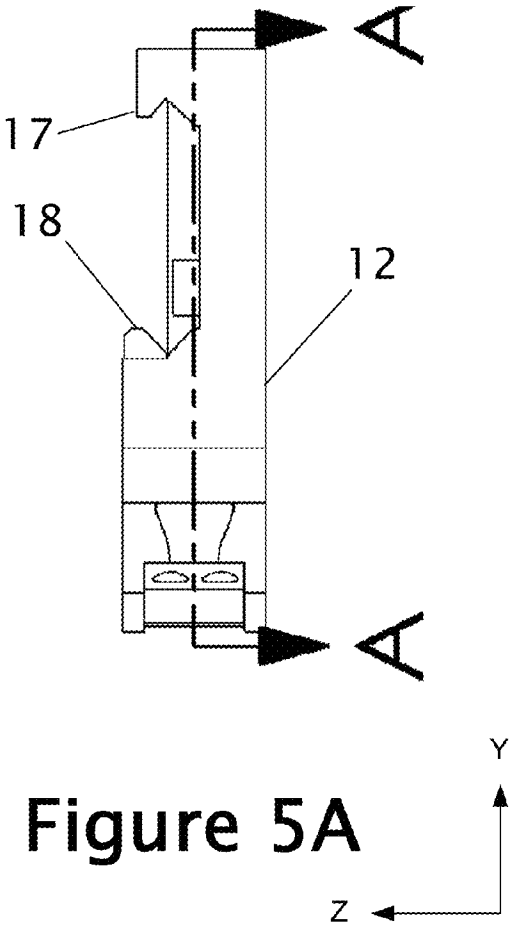
FIG. 5—Edge view (5A) and cross section (5B) along the line A-A'.
Figure 5B:
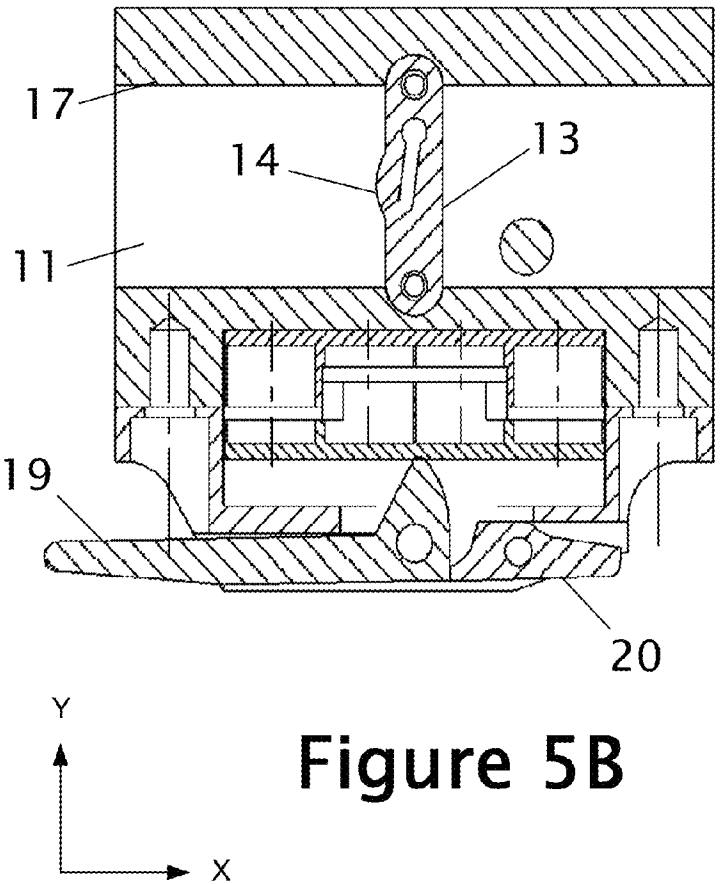

As seen in FIG. 4, the second main embodiment of the weapon interface mounting device (10) is shown utilizing a version of driver housing that is substantially rectangular in the XY plane, having a channel (11) to accommodate a MIL-STD-1913 or similar rail (30). The primary (13) and auxiliary (9) indexing components fit into adjacent crosswise slots (33) scored at regular intervals along the length of the rail (30) shown in FIGS. 8A and 9A. An articulated finger (14) acts as a spring to push against the edge of the ridge (31) flanking a slot (33) in order to accommodate any residual slack. The details of this mated geometry are shown in FIG. 9A. Not only is a tight fit enabled, but when positioned correctly, helps to offset the recoil shock of a fired weapon that would otherwise loosen the interfaced connection. In addition, the indexing system facilitates 100% repeatability with respect to the positioning of the accessory device on the weapons system.

Figure 6A:
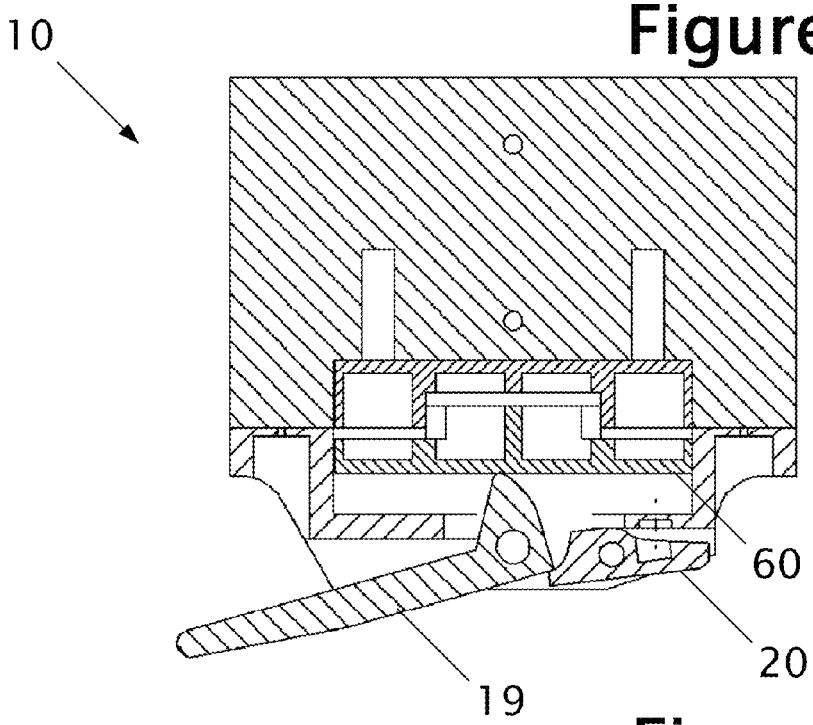
FIG. 6—Cross section showing driver in open (6A) and closed (6B) positions.
FIGS. 6C, 6D—Cross-sections showing the clamping driver system in the closed-lever clamped operational mode and in the open-lever released mode.
Figure 6B:
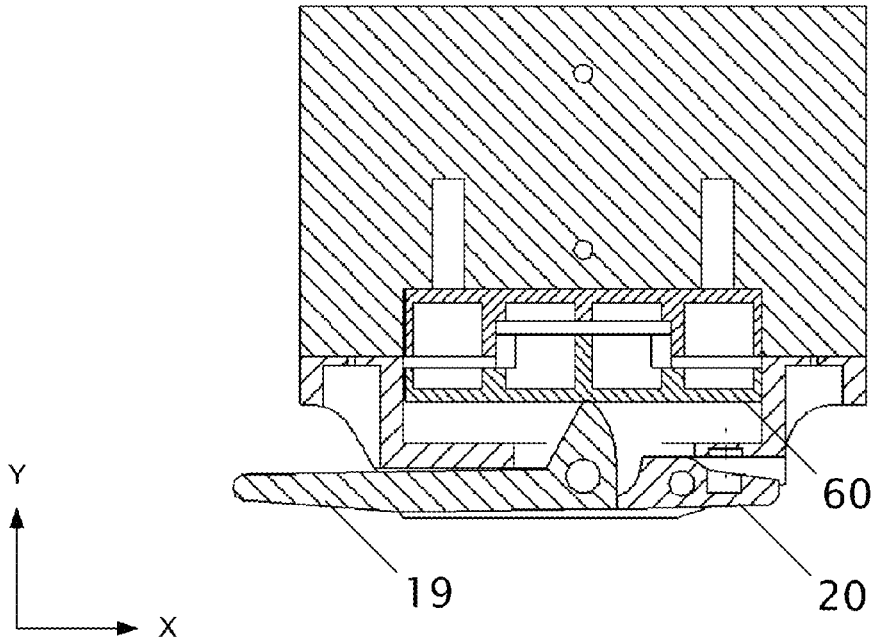
Figures 8A, 8B, 8C:
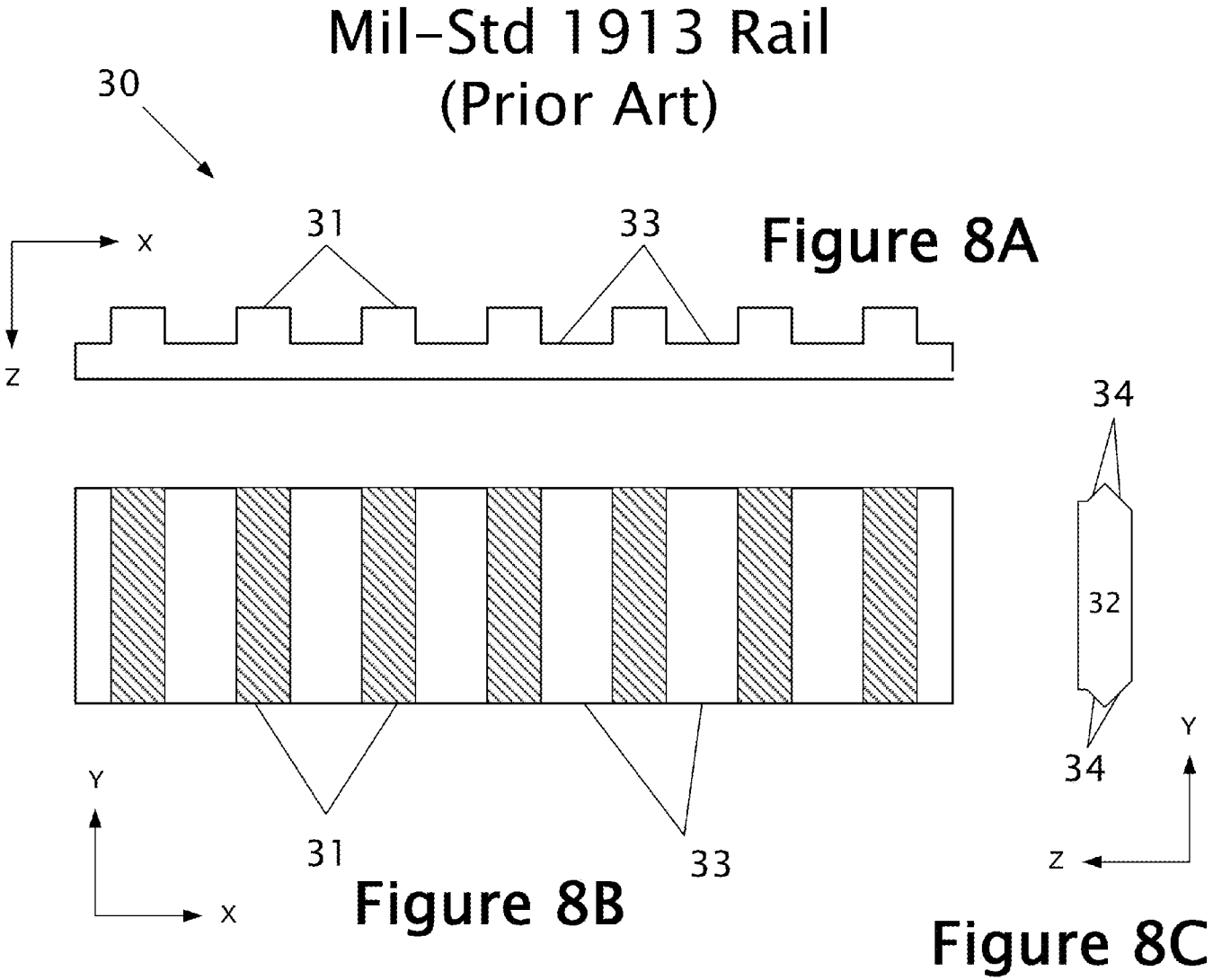
FIG. 8—Alternate views of a standard rail along the three orthogonal axes.
Figure 9B:
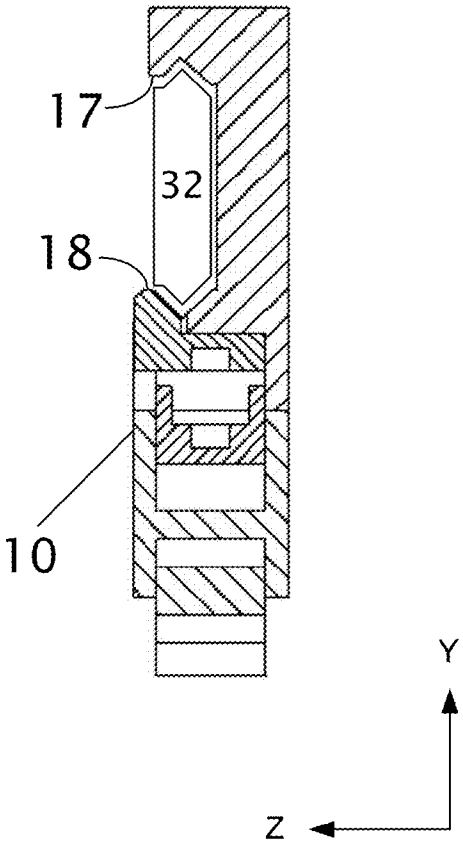
FIG. 9—Views detailing the mating surfaces between the weapon interface mounting device and a standard rail.
Figure 9A:
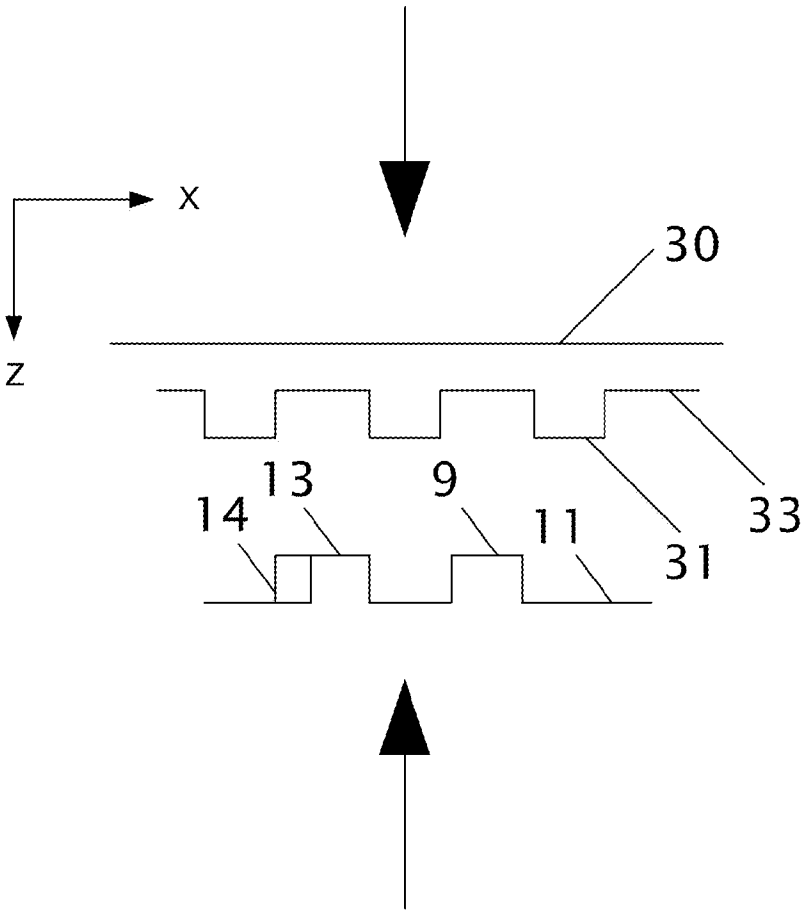

The edges of the channel (11) provides shaped surfaces (17, 18) that are mateable to the outer beveled edges (34) of the rail (30) shown in FIG. 8C. The details of this fit are indicated in FIGS. 8C and 9B. The driver system (15) is actuated by means of a lever (19) 19 as shown in FIG. 6A-6D. The lever 19 locks automatically in the engaged mode by a safety-lock push-bar 20 to prevent unintended release. FIG. 6A shows lever 19 in a released orientation close to the clockwise end of its rotational range. Lever 19 remains unlocked at this orientation since it is holding safety-lock push-bar 20 in a depressed orientation. FIG. 6B shows lever 19 having been rotated clockwise to its operational orientation, locked by safety-lock push-bar 20. When properly deployed, the driver system 15 forces a snug engagement between the shaped surface of the channel (17, 18) and the beveled edges (34) of the rail (30) as detailed in FIG. 9B.

Figure 7A:
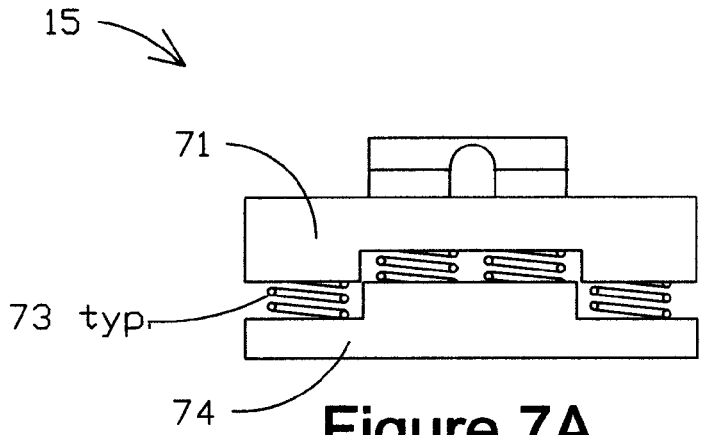
FIG. 7—Detailed view of the assembled (7A) and unassembled (7B) driver.
Figure 7B:
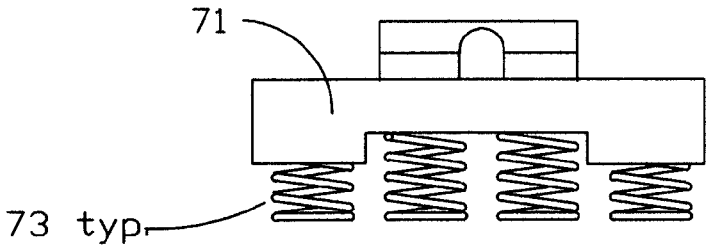
Figure 7C:
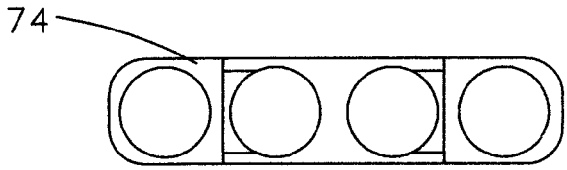

A preferred embodiment of the compressible drive subassembly 15, utilized in both the driver system 16 embodiment and in the clamping device 10 embodiment, is shown in FIG. 7A. The compressible drive subassembly 15 includes a rail-side component, i.e. movable clap jaw (71) and a lever-side component (74) with a compressible drive component implemented as four coil springs 73, therebetween. FIG. 7B shows drive subassembly 15 of FIG. 7A with the lever-side component 74 removed to show the uncompressed extent of coil springs 73. FIG. 7C is a top view of lever-side component 74 (FIG. 7A).

Figures 6C, 6D:
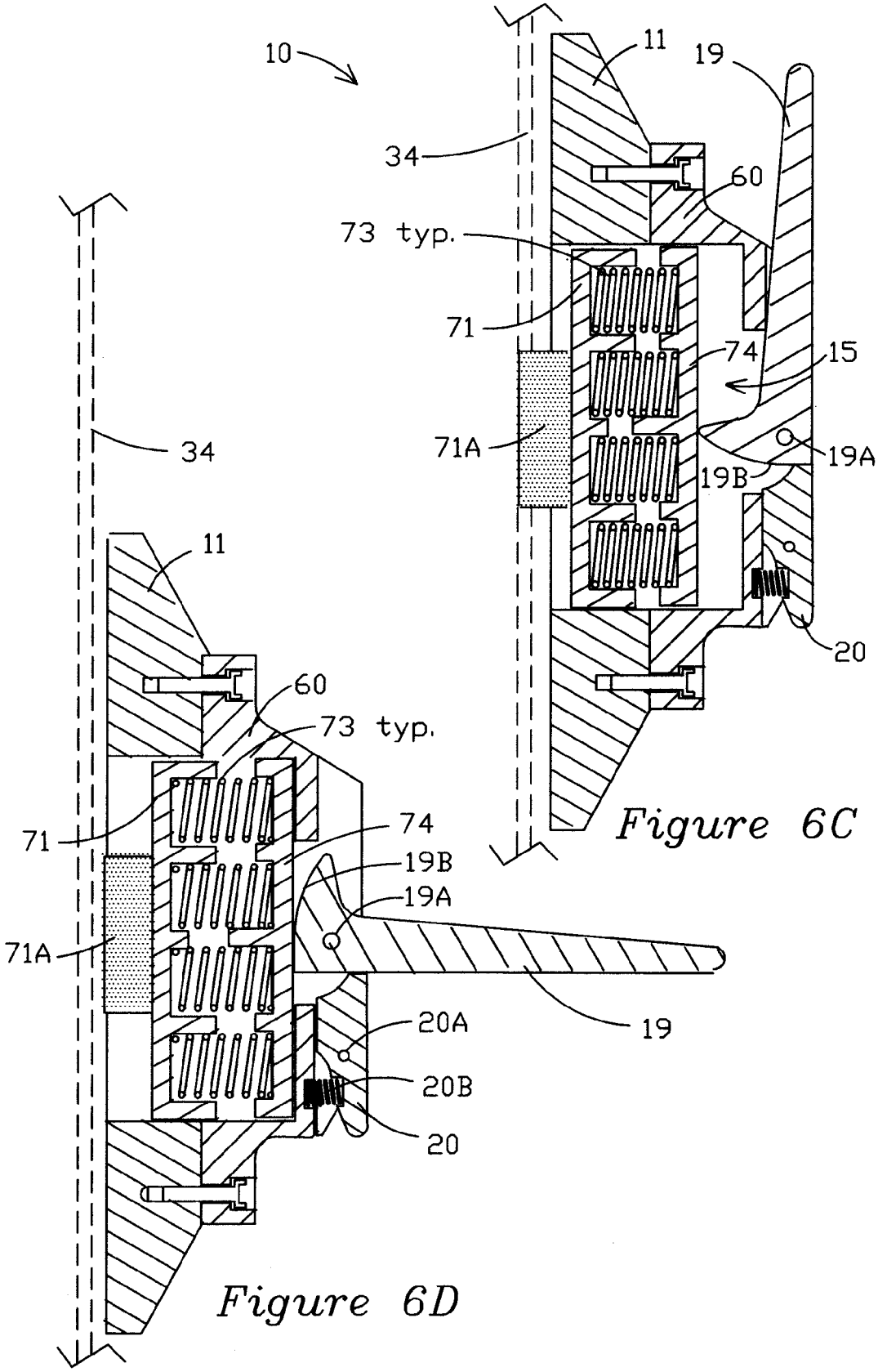

FIG. 6C is a cross-section taken at axis 6C-6C of FIG. 1G, showing a clamping device embodiment incorporating a compressible drive subassembly 15. Lever 19 is shown locked in its engaged mode by safety lock push-bar 20. Part of the rail side component 71 is configured with a surface 18, (FIG. 1G) on offset extension (71A) that is mateable to the beveled edges (34) of a rail (30). This is actuated by a cam portion 19B of the lever (19) being pressed against the lever side component (74) which, by way of the springs (73), urges the rail side component (71) and its mateable surface on offset extension (71A) against an angled facet 72 of the beveled edges (34) of the rail (30) as well as the shaped surface opposite the driving member (17) as shown in FIG. 9B. Because the rail (30) cross section (32) and the mating surfaces (17, 18) are angled in the YZ plane, a component of force is applied in both the Y and Z direction, thereby tightly securing the rail (30) in the YZ plane. Compressible drive component 73, as implemented by the springs or similar equivalent, takes up any slack due to poor manufacturing, recoil, or other effects.

FIG. 6D shows the clamping device of FIG. 6 having been released from clamped engagement with the rail edge 34 by a user urging lever 19 clockwise while depressing the safety lock push-bar 20. With lever 19 having been rotated to the clockwise end of its approximately 90 degree rotational range as shown, further rotation is blocked by the end of safety lock push-bar 20. The lever-side driver. component 74 has been displaced from its locked location shown in FIG. 6C, by a stroke length that is determined by the shape of cam 19B on lever 19. This moves the movable jaw, i.e. offset extension 71A of rail-side component, i.e. movable clamp-jaw 71, clear of the rail edge 34 to allow adjustment or removal from the rail.

The stroke length of rail-side component 71 and its offset extension 72 is less than that of driver-side component 74 by the amount of differential engaged/disengaged compression in the coil springs forming the compressible drive component 73. Rail clearance in the disengaged mode is ensured by a pair of relatively small weak retaining coil springs located toward the far side and thus not visible in this view, recessed and arranged to apply compressive bias force between a lower region of the main clamp body 11 and the rail-side driver component 71, sufficient to ensure required rail clearance in the disengaged mode.

The foregoing descriptions regarding the structure and operation of the driver device are equally applicable to both the first and second main embodiments as claimed.

In this manner, weapon interface mounting device enables a secure interface between a Mil-Std 1913 or similar rail and a compatible component such as an optical device, bipod, or light source. It can be easily installed with the assurance of positioning repeatability, requires no adjustment by the user, and mates securely to rails that are out of specification or poorly manufactured despite the imparted and consistent shock due to recoil of a fired weapon.

The invention claimed is:

1. A clamping driver system for incorporation into a host clamping device as a portion, located at a first end thereof, that includes a movable clamp jaw co-operating with a fixed clamp jaw of the host clamping device, located at a second end thereof, to securely clamp a workpiece therebetween, said clamping driver system comprising:

a lever having a first end region pivotally mounted on a lever pivot pin secured in a base mechanical node in common with the host clamping device, said lever extending to a second end region for user actuation, constrained to a working range of rotation approximating 90 degrees;

a cam formed integrally as a portion of said lever in the first end region thereof;

a compressible drive subassembly, comprising:

a solid lever-driven component receiving driving force and displacement from said cam:

a compressible drive component having a resilient thickness between a first side surface thereof held in operational contact with said solid lever-side driver component; and a second and opposite side surface thereof;

a solid driver component, receiving the driving force and a portion of the displacement from the second side surface of said compressible drive component; configured to constitute the movable clamp jaw;

whereby, a user, manipulating said lever to a first end of the working range, is enabled to initiate a disengaged mode wherein a workpiece of designated dimensions and tolerances can be readily and rapidly relocated between a removed location and a clamping location, regardless of dimensional variations in the workpiece including those due to the tolerances, such variations being compensated by variations in the resilient thickness of said compressible drive component; and whereby, upon user manipulating said lever to a second and opposite end of the working range of rotation, is enabled to initiate an engaged mode wherein the workpiece is held securely clamped in place, between the fixed jaw and the movable jaw, by at least a designated required substantial amount of compressive clamping force, regardless of dimensional variations in the workpiece, due to the tolerances, such variations being compensated by variations in the resilient thickness of said compressible drive component.

2. The clamping driver system as defined in claim 1 further comprising:

a driver enclosure, containing said lever, said cam and at least a major portion of said compressible drive component, thus forming a self-contained driver unit;

said driver enclosure being configured to be boltedly attached onto an interface surface configured on the first end region of said host clamping device; and the first end region being further configured to provide a passageway that enables the movable clamp jaw of said compressible drive component to contact and clamp the workpiece in place.

3. The clamping driver system as defined in claim 1, wherein said lever and said cam are configured such that, in the engaged mode, said lever is made to be oriented in a direction substantially perpendicular to that of applied clamping force.

4. The clamping driver system as defined in claim 3, wherein said cam is shaped to provide in sequence throughout the range of lever rotation (1) the disengaged mode at first end of range orientation, being made unconditionally stable mechanically, (2) an unstable sector, (3) a conditionally stable orientation applying a peak level of clamping force, greater than the required substantial working clamping force, (4) an unstable sector and (5) the engaged mode at second end of range orientation, being made unconditionally stable mechanically and applying at least the required substantial working clamping force.

5. The clamping driver system as defined in claim 4, further comprising at least one retaining spring made and arranged to exert a force on the movable clamp jaw sufficient to retain said compressible component held in contact with said cam upon loss of contact between the movable clamp jaw of said compressible drive component and the workpiece, in the disengaged mode.

6. The clamping driver system as defined in claim 1, wherein said driver system further comprises a safety latch, made and arranged to automatically lock said lever oriented at the second range-end and to thus lock-in the engaged mode whenever manipulated thereto, and to be readily unlockable manually to release said lever for manipulation to the first range-end to initiate the disengaged mode.

7. The clamping driver system as defined in claim 6, wherein said safety latch comprises:

a spring-loaded lock bar mounted pivotedly in the base mechanical node of the clamp structure adjacent the lever pivot pin, made and arranged to interact operationally with a corner configured along with said cam in the first end region of said lever, made, located and arranged to enable a user to manually release the safety latch by pushing said lock bar and thus unlocking said lever to be actuated for initiation of the disengaged mode for removal of the workpiece from said clamping device.

8. The clamping driver system as defined in claim 1, wherein said compressible drive component comprises:

at least one compressible helical coil spring;

a first spring-end retainer part, having a first side configured flat for operational contact with the cam portion of said lever, and having a second and opposite side configured with at least one recessed region retaining a first end of said at least one coil spring; and a second spring-end retainer part, having a first side configured for operational contact with the second edge of said rail, and having a second and opposite side configured with at least one recessed region retaining a second end of said at least one coil spring.

9. The clamping driver system as defined in claim 8, wherein said compressible drive component comprises:

four compressible helical coil springs;

a first spring-end retainer part, having a first side configured flat for operational contact with the cam portion of said lever, and having a second and opposite side configured with four recessed regions, each retaining a first end of a corresponding one of said four coil springs; and a second spring-end retainer part, having a first side configured for operational contact with the workpiece, and having a second and opposite side configured with four recessed regions, each retaining a second end of a corresponding one of said four coil springs.

10. The clamping driver system as defined in claim 1, wherein:

the workpiece is a weapon-mounted MIL-STD 1913 rail having, in an attachment plane, (1) an array of regularly-spaced protrusions forming regular spaces interspersed therebetween, (2) a longitudinal axis collinear with the firing axis of a weapon, and (3) a lateral axis, perpendicular to the longitudinal axis;

the host clamping device is configured with a transverse channel for removable engagement onto a portion of the rail along the firing axis of a weapon; the channel having a first wall constituting the fixed clamp jaw and a second and opposite wall configured with a passageway for allowing the movable clamp jaw to contact the rail for clamping; and said clamp structure, in conjunction with said clamping device, constituting a mounting device of a type intended to provide fast and convenient manually-attachable and manually-removable fastening, via the rail constituting a workpiece, between a weapon and an accessory of the weapon.

11. The clamping driver system defined in claim 10, wherein said clamping driver system further comprises a driver enclosure, containing said clamping driver system and configured with an interface region, said driver enclosure being securely attached at the interface region to an outer surface of the second channel wall of the clamp structure, said driver enclosure and the contained driver system constituting a stand-alone interchangeable clamping driver assembly.

12. A clamping device for fast and convenient manually-attachable and manually-removable fastening between a weapon-mounted MIL-STD 1913 rail and an accessory, the rail having, in an attachment plane, (1) an array of regularly-spaced protrusions forming regular spaces interspersed therebetween, (2) a longitudinal axis collinear with the firing axis of a weapon, and (3) a lateral axis, perpendicular to the longitudinal axis, said clamping device comprising:

a clamp body configured with a channel for removable engagement onto a portion of said rail along the firing axis of a weapon, the channel having a first wall formed by a first flange extending along a first edge of said clamp body bearing directly against a first edge of the rail, and a second and opposite channel wall interfacing and extending along a second and opposite edge of said rail, the second channel wall, formed by a second flange extending along a second and opposite edge of said clamp body, spaced away from said rail by a clearance dimension predetermined to enable rapid "clip-on" attachment with initial engagement of the first channel edge of said clamp body onto the first edge of said rail; and a driver system comprising:

a driver enclosure having a first edge region firmly attached to the second flange of said clamp body, and extending outwardly therefrom to a second edge region;

a lever, for manually deploying clamping action, configured with an integral cam portion, pivotally mounted near the second edge of the driver enclosure; and a compressible drive component, disposed between the cam portion of said lever; and the second edge of said rail, for providing compensation for dimensional tolerances and wear in said rail.

13. The clamping device as defined in claim 12, wherein said lever and integral cam portion are shaped such that (1) when said lever is in a disengaged orientation in the lateral axis, said driving member is held separated from said rail by the predetermined clearance dimension by a retraction spring, (2) when said clamping lever is moved to an engaged orientation in the longitudinal axis, the cam portion acts to force the driving member against the second edge of the rail and thus act as a movable clamp jaw, applying sufficiently strong clamping force to said rail, the first edge thereof being constrained by the first flange of the clamp body, acting as a fixed clamp jaw, and (3) maximum compression of the compressible drive component is made to occur at a designated intermediate orientation between the engaged orientation and the disengaged orientation, to implement bistable toggle performance of said lever wherein both the disengaged orientation (1) and the engaged orientation (2) are made to be stable conditions whereas the intermediate orientation (3) is made to be only conditionally stable, separated from orientations (1) and (2) by unstable regions, thus causing said lever to operate in a toggle manner.

14. The clamping device as defined in claim 12, wherein said driver system further comprises a safety latch, made and arranged to automatically lock said lever positively in place in an engaged orientation whenever manipulated thereto, and to be readily releasable manually to enable manipulation of said lever to the disengaged orientation.

15. The clamping device as defined in claim 14, wherein said safety latch comprises:

a, push-bar configured integrally in an exposed location, adjacent to said lever, made, located and arranged to enable a user to manually release the safety latch by pushing said push-bar and thus unlocking said lever to enable removal of said clamping device from said rail.

16. The clamping device as defined in claim 12, wherein said compressible drive component comprises:

at least one compressible helical coil spring;

a first spring-end retainer part, having a first side configured flat for operational contact with the cam portion of said lever, and having a second and opposite side configured with at least one recessed region retaining a first end of said at least one coil spring; and a second spring-end retainer part, having a first side configured for operational contact with the second edge of said rail, and having a second and opposite side configured with at least one recessed region retaining a second end of said at least one coil spring.

17. The clamping device as defined in claim 16, wherein said compressible drive component comprises:

four compressible helical coil springs;

a first spring-end retainer part, having a first side configured flat for operational contact with the cam portion of said lever, and having a second and opposite side configured with four recessed regions, each retaining a first end of a corresponding one of said four coil springs; and a second spring-end retainer part, having a first side configured for operational contact with the second edge of said rail, and having a second and opposite side configured with four recessed regions, each retaining a second end of a corresponding one of said four coil springs.

18. The clamping device as defined in claim 12, further comprising:

a primary indexing component implemented as a flat elongate strip of material located in said clamp body traversing the channel thereof; and an articulated finger extending along a first edge of said indexing component, attached thereto in a resilient cantilevered manner, the finger having an outer edge configured with an arcuate protrusion, said indexing component being made, dimensioned and arranged to fit into the space between designated ones of the protrusions in said clamping device in a manner such that the finger applies a force that urges a second edge of said indexing component securely and positively against at least one adjacent protrusion in a favorable direction for the purpose of preventing shifting of the clamping device along said track due to impact of recoil shock from firing of the weapon.

* * * * *